US010224603B2

(12) United States Patent
Shin et al.

(10) Patent No.: US 10,224,603 B2
(45) Date of Patent: Mar. 5, 2019

(54) ANTENNA USING COUPLING AND ELECTRONIC DEVICE INCLUDING THE SAME

(71) Applicant: Samsung Electronics Co., Ltd., Gyeonggi-do (KR)

(72) Inventors: Dong Ryul Shin, Daegu (KR); Min Sakong, Gyeongsangbuk-do (KR); Chae Up Yoo, Seoul (KR); Jin Woo Jung, Seoul (KR); Ho Saeng Kim, Gyeonggi-do (KR); Byung Chan Jang, Gyeongsangbuk-do (KR)

(73) Assignee: Samsung Electronics Co., Ltd (KR)

( * ) Notice: Subject to any disclaimer, the term of this patent is extended or adjusted under 35 U.S.C. 154(b) by 10 days.

(21) Appl. No.: 14/922,967

(22) Filed: Oct. 26, 2015

(65) Prior Publication Data

US 2016/0118710 A1 Apr. 28, 2016

(30) Foreign Application Priority Data

Oct. 24, 2014 (KR) ..... 10-2014-0145540

(51) Int. Cl.
*H01Q 1/24* (2006.01)
*H01Q 5/378* (2015.01)
*H01Q 9/42* (2006.01)

(52) U.S. Cl.
CPC ..... *H01Q 1/243* (2013.01); *H01Q 1/241* (2013.01); *H01Q 5/378* (2015.01); *H01Q 9/42* (2013.01)

(58) Field of Classification Search
CPC ..... H01Q 1/243
See application file for complete search history.

(56) References Cited

U.S. PATENT DOCUMENTS

| | | | |
|---|---|---|---|
| 7,450,072 | B2 | 11/2008 | Kim et al. |
| 8,270,914 | B2 | 9/2012 | Pascolini et al. |
| 8,842,048 | B2 | 9/2014 | Kim et al. |
| 9,059,506 | B2 | 6/2015 | Kim et al. |
| 9,306,276 | B2 | 4/2016 | Shi et al. |
| 2007/0132654 | A1 | 6/2007 | Ozkar |
| 2007/0229366 | A1 | 10/2007 | Kim et al. |
| 2010/0231461 | A1 | 9/2010 | Tran |
| 2011/0136447 | A1 | 6/2011 | Pascolini et al. |
| 2011/0241964 | A1 | 10/2011 | Kim |
| 2012/0262345 | A1 | 10/2012 | Kim et al. |
| 2013/0009828 | A1 | 1/2013 | Pascolini et al. |
| 2013/0016024 | A1 | 1/2013 | Shi et al. |
| 2013/0044030 | A1 | 2/2013 | Oh |

(Continued)

FOREIGN PATENT DOCUMENTS

| | | |
|---|---|---|
| EP | 2 763 240 | 8/2014 |
| KR | 20140020670 A | 2/2014 |

(Continued)

OTHER PUBLICATIONS

European Search Report dated Mar. 29, 2016 issued in counterpart application No. 15191118.7-1812, 6 pages.

*Primary Examiner* — Robert Karacsony
(74) *Attorney, Agent, or Firm* — The Farrell Law Firm, P.C.

(57) ABSTRACT

An electronic device is provided. The electronic device includes a housing including a segment part used to insulate a portion of the housing and an antenna disposed at a position corresponding to the segment part.

11 Claims, 13 Drawing Sheets

(56) References Cited

U.S. PATENT DOCUMENTS

| | | | | |
|---|---|---|---|---|
| 2014/0218247 | A1 | 8/2014 | Tefiku | |
| 2014/0354491 | A1 | 12/2014 | Kim et al. | |
| 2015/0123871 | A1* | 5/2015 | Chang | H01Q 1/243 343/872 |
| 2015/0255857 | A1 | 9/2015 | Kim et al. | |

FOREIGN PATENT DOCUMENTS

| | | |
|---|---|---|
| KR | 1020140031027 | 3/2014 |
| KR | 1020140034932 | 3/2014 |

* cited by examiner

ANTENNA USING COUPLING AND ELECTRONIC DEVICE INCLUDING THE SAME

PRIORITY

This application claims priority under 35 U.S.C. § 119(a) to Korean Patent Application Ser. No. 10-2014-0145540, which was filed on Oct. 24, 2014 in the Korean Intellectual Property Office, the entire disclosure of which is incorporated herein by reference.

BACKGROUND

1. Field of the Disclosure

The present disclosure relates generally to an electronic device, and more particularly, to an electronic device that includes an antenna using various coupling configurations for attaching to a metal case of the electronic device.

2. Description of the Related Art

With recent developments of communication technology, network devices such as base stations have been installed throughout the country, which allows electronic devices to use networks anywhere in the country.

Electronic devices include antennas (or intennas) which allow the electronic devices to communicate over the networks. In some instances, a metal case of an electronic device is used as part of an antenna assembly of the electronic device.

While such antenna assembly configurations are suitable for their intended purpose, there remains a need for alternative coupling configurations for attaching an antenna of an electronic device to a metal case of the electronic device.

SUMMARY

The present disclosure has been made to address at least the above mentioned problems and/or disadvantages and to provide at least the advantages described below. Accordingly, an aspect of the present disclosure is to provide an electronic device that includes an antenna using various coupling configurations for attaching to a metal case of the electronic device.

In accordance with an aspect of the present disclosure, there is provided an electronic device. The electronic device includes a housing including a segment part used to insulate a portion of the housing and an antenna disposed at a position corresponding to the segment part.

In accordance with another aspect of the present disclosure, there is provided an antenna. The antenna includes an antenna pattern, a feeding part configured to supply power to the antenna, and a ground part coupled to a ground area of an electronic device, wherein an end of the antenna pattern is disposed at a position corresponding to a segment part which is configured to insulate a portion of a housing of the electronic device.

BRIEF DESCRIPTION OF THE DRAWINGS

The above and other aspects, features, and advantages of certain embodiments of the present invention will be more apparent from the following detailed description taken in conjunction with the accompanying drawings, in which.

DETAILED DESCRIPTION

Figure 1:
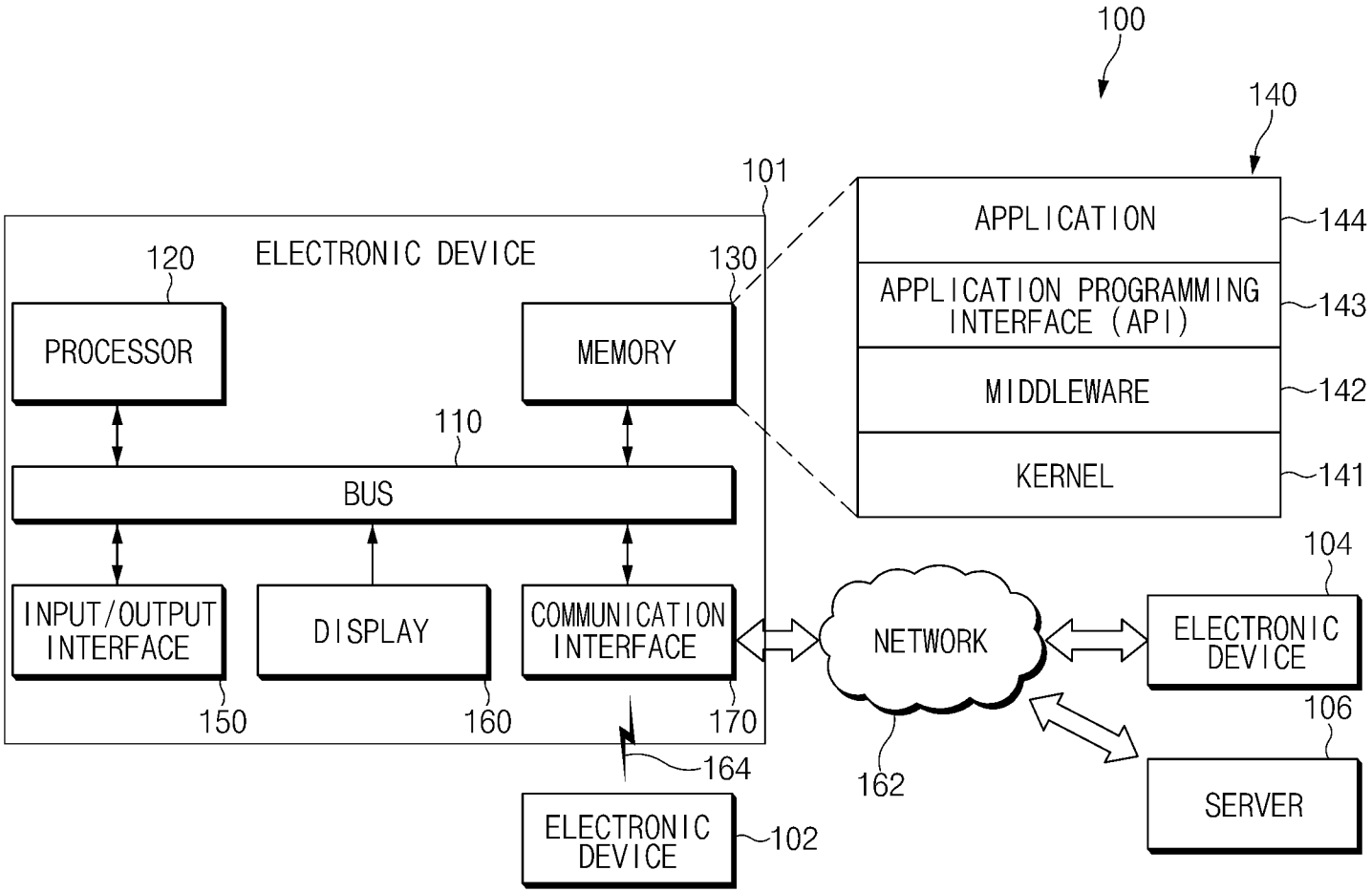
FIG. 1 is a diagram illustrating an electronic device in a network environment, according to an embodiment of the present disclosure.

Hereinafter, various embodiments of the present disclosure are disclosed with reference to the accompanying drawings. However, this does not limit various embodiments of the present disclosure to a specific embodiment and it should be understood that the present disclosure covers all the modifications, equivalents, and/or alternatives of this disclosure provided they come within the scope of the appended claims and their equivalents. With respect to the descriptions of the drawings, like reference numerals refer to like elements.

The terms "include," "comprise," and "have", or "may include," or "may comprise" and "may have" as used herein indicate disclosed functions, operations, or existence of elements but do not exclude other functions, operations or elements.

For instance, the expressions "A or B", or "at least one of A or/and B" may indicate include A, B, or both A and B. For instance, the expressions "A or B", or "at least one of A or/and B" may indicate (1) at least one A, (2) at least one B, or (3) both at least one A and at least one B.

The terms such as "1st", "2nd", "first", "second", and the like used herein may refer to modifying various different elements of various embodiments of the present disclosure, but do not limit the elements. For instance, "a first user device" and "a second user device" may indicate different users regardless of the order or the importance. For example, a first component may be referred to as a second component and vice versa without departing from the scope of the present disclosure.

In various embodiments of the present disclosure, it will be understood that when a component (for example, a first component) is referred to as being "(operatively or communicatively) coupled with/to" or "connected to" another component (for example, a second component), the component may be directly connected to the other component or connected through another component (for example, a third component). In various embodiments of the present disclosure, it will be understood that when a component (for example, a first component) is referred to as being "directly connected to" or "directly accesses" another component (for example, a second component), an additional component (for example, a third component) does not exist between the component (for example, the first component) and the other component (for example, the second component).

The expression "configured to" used in various embodiments of the present disclosure may be interchangeably used with "suitable for", "having the capacity to", "designed to", "adapted to", "made to", or "capable of" according to a situation. The term "configured to" may not necessarily mean "specifically designed to" in terms of hardware. Instead, the expression "a device configured to" in some situations may mean that the device and another device or part are "capable of". For example, "a processor configured to perform A, B, and C" in a phrase may mean a dedicated processor (for example, an embedded processor) for performing a corresponding operation or a generic-purpose processor (for example, a CPU or application processor) for performing corresponding operations by executing at least one software program stored in a memory device.

The term "module" used in various embodiments of the present disclosure, for example, may mean a unit including a combination of at least one of hardware, software, and firmware. The term "module" and the term "unit", "logic", "logical block", "component", or "circuit" may be interchangeably used. A "module" may be a minimum unit or part of an integrally configured component. A "module" may be a minimum unit performing at least one function or part thereof. A "module" may be implemented mechanically or electronically. For example, "module" may include at least one of an application-specific integrated circuit (ASIC) chip performing certain operations, field-programmable gate arrays (FPGAs), or a programmable-logic device, all of which are known or to be developed in the future.

Terms used in various embodiments of the present disclosure are used to describe specific embodiments of the present disclosure, and are not intended to limit the scope of other embodiments. The terms of a singular form may include plural forms unless they have a clearly different meaning in the context. Otherwise indicated herein, all the terms used herein, which include technical or scientific terms, may have the same meaning that is generally understood by a person skilled in the art. In general, the terms defined in the dictionary should be considered to have the same meaning as the contextual meaning of the related art, and, unless clearly defined herein, should not be understood differently or as having an excessively formal meaning. In any case, even the terms defined in this specification cannot be interpreted as excluding embodiments of the present disclosure.

As described herein, an electronic device may include at least one of smartphones, tablet personal computers (PCs), mobile phones, video phones, electronic book (e-book) readers, desktop personal computers (PCs), laptop personal computers (PCs), netbook computers, workstation servers, personal digital assistants (PDAs), portable multimedia players (PMPs), MP3 players, mobile medical devices, cameras, and wearable devices (for example, smart glasses, head-mounted-devices (HMDs), electronic apparel, electronic bracelets, electronic necklaces, electronic appcessories, electronic tattoos, smart mirrors, and smart watches), all of which include an antenna, which will be described in detail below with reference to FIGS. 1-8C.

The electronic device may be smart home appliances which can include an antenna in accordance with the present disclosure. The smart home appliances may include at least one of, for example, televisions, digital video disk (DVD) players, audios, refrigerators, air conditioners, cleaners, ovens, microwave ovens, washing machines, air cleaners, set-top boxes, home automation control panels, security control panels, TV boxes (e.g., Samsung HomeSync®, Apple TV® or Google TV®), game consoles (for example, Xbox® and PlayStation®), electronic dictionaries, electronic keys, camcorders, and electronic picture frames.

The electronic device may include at least one of various medical devices supporting call forwarding services (for example, various portable measurement devices (for example, glucometers, heart rate meters, blood pressure meters, thermometers, etc.), magnetic resonance angiography (MRA) devices, magnetic resonance imaging (MRI) devices, computed tomography (CT) devices, medical imaging devices, ultrasonic devices, etc.), navigation devices, global positioning system (GPS) receivers, event data recorders (EDRs), flight data recorders (FDRs), vehicle infotainment devices, marine electronic equipment (for example, marine navigation systems, gyro compasses, etc.), avionics, security equipment, vehicle head units, industrial or household robots, financial institutions' automatic teller machines (ATMs), or stores' point of sales (POS) devices, or Internet of Things devices (for example, bulbs, various sensors, electric or gas meters, sprinkler systems, fire alarms, thermostats, street lights, toasters, exercise equipment, hot water tanks, heaters, boilers, etc.), all of which can include an antenna in accordance with the present disclosure.

The electronic device including an antenna described herein may include at least one of part of furniture or buildings/structures supporting call forwarding service, electronic boards, electronic signature receiving devices, projectors, and various measuring instruments (for example, water, electricity, gas, or radio signal measuring instruments). An electronic device may be one of the above-mentioned various devices or a combination thereof.

Additionally, the electronic device may be a flexible electronic device including an antenna described herein. Additionally, the electronic device is not limited to the above-mentioned devices and may include a new kind of an electronic device according to new technology development.

Hereinafter, the electronic device will be described in more detail with reference to the accompanying drawings. The term "user" as used herein may refer to a person using an electronic device or a device using an electronic device (for example, an artificial intelligence electronic device).

FIG. 1 is a diagram illustrating an electronic device 101 in a network environment 100, according to an embodiment of the present disclosure.

Referring to FIG. 1, the electronic device 101 includes a bus 110, a processor 120, a memory 130, an input/output interface 150, a display 160, and a communication interface 170. The electronic device 101 may omit at least one of the components or may additionally include a different component.

The bus 110, for example, may include a circuit for connecting the components 110-170 to each other and delivering a communication (for example, control message and/or data) therebetween.

The processor 120 may include at least one of a central processing unit (CPU), an application processor (AP), and a communication processor (CP). The processor 120, for example, may execute calculation or data processing for control and/or communication of at least one another component of the electronic device 101.

The memory 130 may include volatile and/or nonvolatile memory. The memory 130, for example, may store instructions or data relating to at least one other component of the electronic device 101. The memory 130 stores software and/or programs 140. The programs 140 include a kernel 141, a middleware 142, an application programming interface (API) 143, and/or an application program (or an application) 144. At least part of the kernel 141, the middleware 142, or the API 143 may be called an operating system (OS).

The kernel 141, for example, may control or manage system resources (for example, the bus 110, the processor 120, the memory 130, etc.) used for performing operations or functions implemented in other programs (for example, the middleware 142, the API 143, or the application program 144). Additionally, the kernel 141 may provide an interface for controlling or managing system resources by accessing an individual component of the electronic device 101 from the middleware 142, the API 143, or the application program 144.

The middleware 142, for example, may serve as an intermediary role for exchanging data as the API 143 or the application program 144 communicates with the kernel 141.

Additionally, the middleware 142 may process at least one job request received from the application program 144 according to a priority. For example, the middleware 142 may assign to at least one application program 144 a priority for using a system resource (for example, the bus 110, the processor 120, or the memory 130) of the electronic device 101. For example, the middleware 142 may perform scheduling or load balancing on the at least one job request by processing the at least one job request according to the priority assigned to the at least one job request.

The API 143, as an interface for allowing the application program 144 to control a function provided from the kernel 141 or the middleware 142, may include at least one interface or function (for example, an instruction) for file control, window control, image processing, or character control.

The input/output interface 150, for example, may serve as an interface for delivering instructions or data inputted from a user or another external device to another component(s) of the electronic device 101. Additionally, the input/output interface 150 may output instructions or data received from another component(s) of the electronic device 101 to a user or another external device.

The display 160, for example, may include a liquid crystal display (LCD), a light emitting diode (LED) display, an organic light emitting diode (OLED) display, a microelectromechanical systems (MEMS) display, or an electronic paper display. The display 160 may display various content (for example, text, image, video, icon, symbol, etc.) to a user. The display 160 may include a touch screen, and for example, may receive a touch, gesture, proximity, or hovering input by using an electronic pen or a user's body part.

The communication interface 170, for example, may set a communication between the electronic device 101 and an external device (for example, a first external electronic device 102, a second external electronic device 104, or a server 106). For example, the communication interface 170 may communicate with the second external electronic device 104 or the server 106 in connection to a network 162 through wireless communication or wired communication.

The wireless communication may use at least one of long-term evolution (LTE), LTE-advance (LTE-A), code division multiple access (CDMA), wideband CDMA (WCDMA), universal mobile telecommunications system (UMTS), wireless broadband (WiBro), or global system for mobile communications (GSM) as a cellular communication protocol, for example. Additionally, the wireless communication, for example, may include a short-range communication 164. The short range communication 164, for example, may include at least one of wireless fidelity (WiFi), Bluetooth (BT), near field communication (NFC), global positioning system (GPS), etc. The wired communication, for example, may include at least one of universal serial bus (USB), high definition multimedia interface (HDMI), recommended standard 232 (RS-232), and plain old telephone service (POTS). The network 162 may include a telecommunications network, for example, at least one of computer network (for example, local area network (LAN) or wide area network (WAN)), internet, and telephone network.

Each of the first and second external electronic devices 102 and 104 may be the same or different type as the electronic device 101. The server 106 may include a group of one or more servers. All or part of operations executed on the electronic device 101 may be executed on the electronic devices 102 or 104 or the server 106. When the electronic device 101 performs a certain function or service automatically or by a request, it may request at least part of a function relating thereto from the electronic devices 102 or 104 or the server 106 instead of or in addition to executing the function or service by itself. The external electronic devices 102 or 104 or the server 106 may execute a requested function or an additional function and may deliver an execution result to the electronic device 101. The electronic device 101 may provide the requested function or service as it is or by additionally processing the received result. For this, cloud computing, distributed computing, or client-server computing technology may be used.

Figure 2:
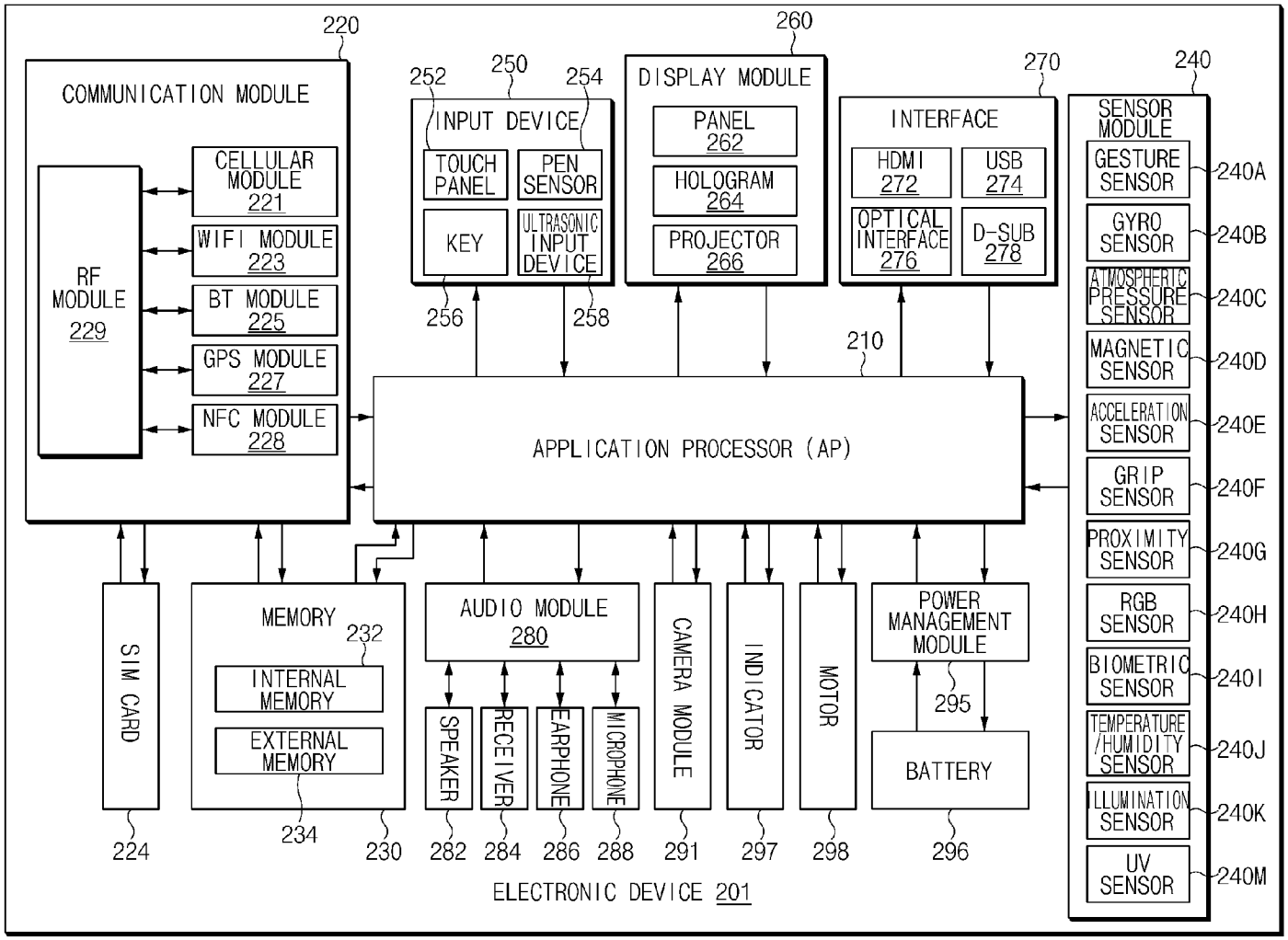
FIG. 2 is a diagram illustrating an electronic device, according to an embodiment of the present disclosure.

FIG. 2 is a diagram of an electronic device 201, according to an embodiment of the present disclosure.

Referring to FIG. 2, the electronic device 201, for example, may include all or part of the above-mentioned components of the electronic device 101 of FIG. 1. The electronic device 201 may include at least one processor (for example, an application processor (AP) 210), a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298.

The processor 210 may control a plurality of hardware or software components connected to the processor 210 and also may perform various data processing and operations by executing an operating system or an application program. The processor 210 may be implemented with a system on chip (SoC), for example. The processor 210 may further include a graphic processing unit (GPU) and/or an image signal processor. The processor 210 may include at least part (for example, the cellular module 221) of components shown in FIG. 2. The processor 210 may load commands or data received from at least one of other components (for example, nonvolatile memory) and process them and may store various data in a nonvolatile memory.

The communication module 220 may have the same or similar configuration to the communication interface 170 of FIG. 1. The communication module 220 includes a cellular module 221, a WiFi module 223, a BT module 225, a GPS module 227, an NFC module 228, and a radio frequency (RF) module 229.

The cellular module 221, for example, may provide voice call, video call, text service, or internet service through communication network. The cellular module 221 may perform a distinction and authentication operation on the electronic device 201 in a communication network by using the SIM card 224. The cellular module 221 may perform at least part of a function that the processor 210 provides. The cellular module 221 may further include a communication processor (CP).

Each of the WiFi module 223, the BT module 225, the GPS module 227, and the NFC module 228 may include a processor for processing data transmitted/received through a corresponding module. At least part (for example, at least one) of the cellular module 221, the WiFi module 223, the BT module 225, the GPS module 227, and the NFC module 228 may be included in one integrated chip (IC) or IC package.

The RF module 229, for example, may transmit/receive communication signals (for example, RF signals). The RF module 229, for example, may include a transceiver, a power amp module (PAM), a frequency filter, a low noise amplifier (LNA), or an antenna. At least one of the cellular module 221, the WiFi module 223, the Bluetooth module 225, the GPS module 227, and the NFC module 228 may transmit/receive RF signals through a separate RF module.

The SIM card 224 may include an embedded SIM and also may include unique identification information (for example, an integrated circuit card identifier (ICCID)) or subscriber information (for example, an international mobile subscriber identity (IMSI)).

The memory 230 includes an internal memory 232 and an external memory 234. The internal memory 232 may include at least one of a volatile memory (for example, dynamic random access memory (RAM) dynamic RAM (DRAM), static RAM (SRAM), synchronous dynamic RAM (SDRAM)) and a non-volatile memory (for example, one time programmable ROM (OTPROM), programmable ROM (PROM), erasable and programmable ROM (EPROM), electrically erasable and programmable ROM (EEPROM), mask ROM, flash ROM, flash memory (for example, NAND flash memory or NOR flash memory), hard drive, or solid state drive (SSD)).

The external memory 234 may further include flash drive, for example, compact flash (CF), secure digital (SD), micro-SD, mini-SD, extreme digital (xD), (multimediacard (MMC), or a memorystick. The external memory 234 may be functionally and/or physically connected to the electronic device 201 through various interfaces.

The sensor module 240 measures physical quantities or detects an operating state of the electronic device 201, thereby converting the measured or detected information into electrical signals. The sensor module 240 may include at least one of a gesture sensor 240A, a gyro sensor 240B, a barometric pressure sensor 240C, a magnetic sensor 240D, an acceleration sensor 240E, a grip sensor 240F, a proximity sensor 240G, a color sensor 240H (for example, a red, green, blue (RGB) sensor), a biometric sensor 240I, a temperature/humidity sensor 240J, an illumination sensor 240K, and an ultra violet (UV) sensor 240M. Additionally or alternatively, the sensor module 240 may include an E-nose sensor, an electromyography (EMG) sensor, an electroencephalogram (EEG) sensor, an electrocardiogram (ECG) sensor, an infra red (IR) sensor, an iris sensor, or a fingerprint sensor. The sensor module 240 may further include a control circuit for controlling at least one sensor therein. The electronic device 201 may further include a processor configured to control the sensor module 240 as part of or separately from the processor 210 and thus may control the sensor module 240 while the processor 210 is in a sleep state.

The input device 250 may include a touch panel 252, a (digital) pen sensor 254, a key 256, or an ultrasonic input device 258. The touch panel 252 may use at least one of capacitive, resistive, infrared, or ultrasonic methods, for example, for detecting a touch input by a user. Additionally, the touch panel 252 may further include a control circuit. The touch panel 252 may further include a tactile layer to provide tactile response to a user.

The (digital) pen sensor 254, for example, may include a sheet for recognition as part of a touch panel or a separate sheet for recognition. The key 256 may include a physical button, an optical key, or a keypad, for example. The ultrasonic input device 258 may detect ultrasonic waves generated from an input tool through a microphone 288 in order to check data corresponding to the detected ultrasonic waves.

The display 260 may include a panel 262, a hologram device 264, or a projector 266. The panel 262 may have the same or similar configuration to the display 160 of FIG. 1. The panel 262 may be implemented to be flexible, transparent, or wearable, for example. The panel 262 and the touch panel 252 may be configured with one module. The hologram device 264 may project three-dimensional images in the air by using the interference of light. The projector 266 may display an image by projecting light on a screen. The screen, for example, may be placed inside or outside the electronic device 201. The display 260 may further include a control circuit for controlling the panel 262, the hologram device 264, or the projector 266.

The interface 270 may include an HDMI 272, a USB 274, an optical interface 276, or a D-subminiature (sub) 278, for example. The interface 270, for example, may be included in the communication interface 170 of FIG. 1. Additionally or alternatively, the interface 270 may include a mobile high-definition link (MHL) interface, a secure Digital (SD) card/multi-media card (MMC) interface, or an infrared data association (IrDA) standard interface.

The audio module 280 may convert sound into electrical signals and convert electrical signals into sounds. At least some components of the audio module 280, for example, may be included in the input/output interface 150 of FIG. 1. The audio module 280 may process sound information inputted/outputted through a speaker 282, a receiver 284, an earphone 286, or the microphone 288.

The camera module 291, as a device for capturing a still image and a video, may include at least one image sensor (for example, a front sensor or a rear sensor), a lens, an image signal processor (ISP), or a flash (for example, an LED or a xenon lamp).

The power management module 295 may manage the power of the electronic device 201. The power management module 295 may include a power management IC (PMIC), a charger IC, or a battery gauge. The PMIC may have a wired and/or wireless charging method. As for the wireless charging method, a magnetic resonance method, a magnetic induction method, or an electromagnetic method may be used. An additional circuit for wireless charging, a circuit such as a coil loop, a resonant circuit, or a rectifier circuit, may be added. The battery gauge may measure the remaining amount of the battery 296, or a voltage, current, or temperature thereof during charging. The battery 296, for example, may include a rechargeable battery and/or a solar battery.

The indicator 297 may display a specific state of the electronic device 201 or part thereof (for example, the processor 210), for example, a booting state, a message state, or a charging state. The motor 298 may convert electrical signals into mechanical vibration and may generate vibration or haptic effect. Although not shown in the drawings, the electronic device 201 may include a processing device (for example, a GPU) for mobile TV support. A processing device for mobile TV support may process media data according to the standards such as digital multimedia broadcasting (DMB), digital video broadcasting (DVB), or mediaFLO.

Each of the above-mentioned components of the electronic device 201 may be configured with at least one component and the name of a corresponding component may vary according to the kind of an electronic device that the electronic device 201 is embodied, e.g., smart phone, tablet, etc. The electronic device 201 may include at least one of the above-mentioned components, may not include some of the above-mentioned components, or may further include another component. Additionally, some of components in the electronic device 201 may be configured as one entity, so that functions of previous corresponding components are performed identically.

Figure 3:
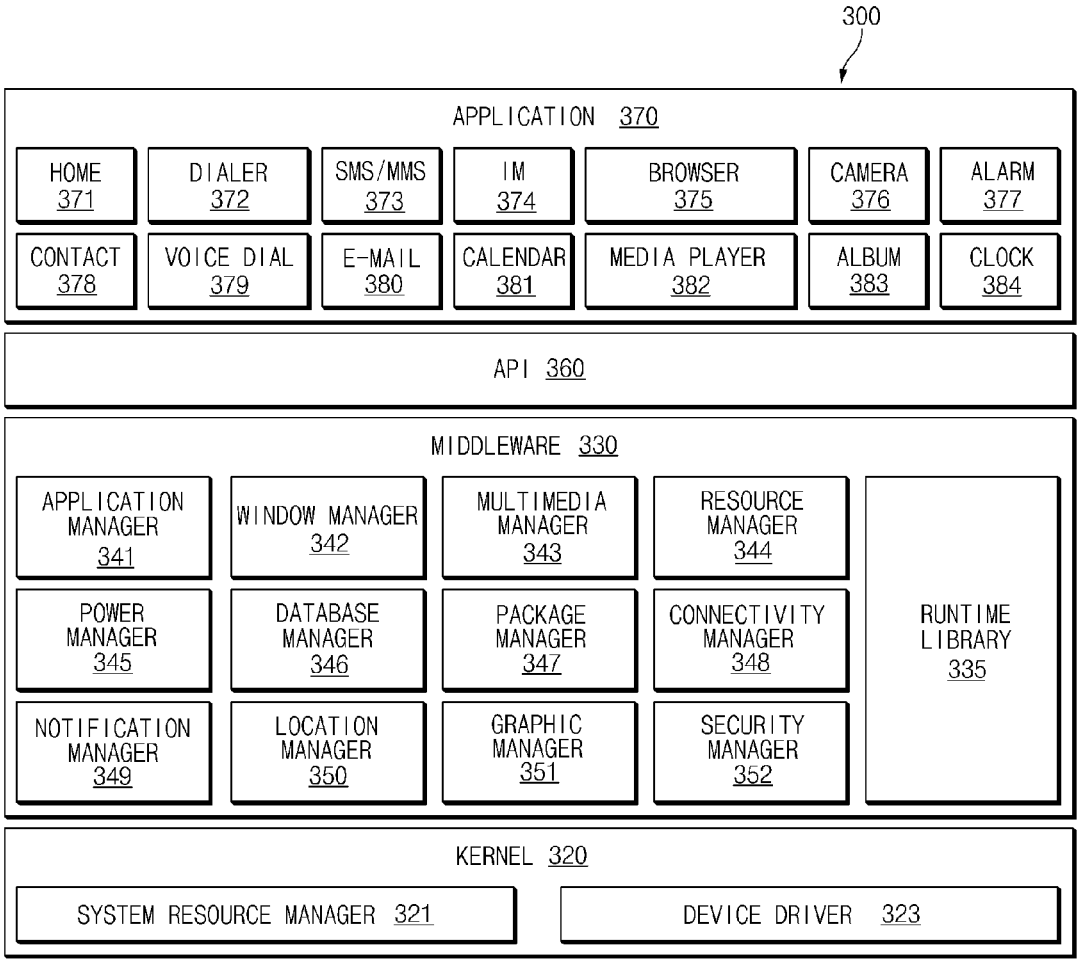
FIG. 3 is a diagram illustrating a program module, according to an embodiment of the present disclosure.

FIG. 3 is a diagram of a program module 310 which may be included in either of the electronic devices 101/201 (hereinafter "the electronic device"), according to an embodiment of the present disclosure.

Referring to FIG. 3, the program module 310 may include an operating system (OS) for controlling a resource relating to the electronic device and/or various applications (for example, the application program 147) running on the OS. The OS, for example, may include Android®, iOS®, Windows®, Symbian®, Tizen®, or Bada®.

The program module 310 includes a kernel 320, a middleware 330, an API 360, and/or an application 370. At least part of the program module 310 may be preloaded on the electronic device or may be downloaded from the server device 106.

The kernel 320 includes a system resource manager 321 and a device driver 323. The system resource manager 321 may perform the control, allocation, or retrieval of a system resource. The system resource manager 321 may include a process management unit, a memory management unit, or a file system management unit. The device driver 323 may include a display driver, a camera driver, a Bluetooth driver, a sharing memory driver, a USB driver, a keypad driver, a WiFi driver, an audio driver, and/or an inter-process communication (IPC) driver.

The middleware 330 may provide a function that the application 370 requires commonly, or may provide various functions to the application 370 through the API 360 in order to allow the application 370 to efficiently use a limited system resource inside the electronic device. The middleware 330 includes at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include a library module that a complier uses to add a new function through a programming language while the application 370 is running. The runtime library 335 may perform a function on input/output management, memory management, or an arithmetic function.

The application manager 341 may mange the life cycle of at least one application among the applications 370. The window manager 342 may manage a GUI resource used in a screen. The multimedia manager 343 may recognize a format for playing various media files and may encode or decode a media file by using the codec corresponding to a corresponding format. The resource manager 344 may manage a resource such as a source code, a memory, or a storage space of at least any one of the applications 370.

The power manager 345 may operate together with a basic input/output system (BIOS) to manage the battery or power and may provide power information necessary for an operation of the electronic device. The database manager 346 may create, search, or modify a database used in at least one application among the applications 370. The package manager 347 may manage the installation or update of an application distributed in a package file format.

The connectivity manger 348 may manage a wireless connection such as WiFi or Bluetooth. The notification manager 349 may display or notify an event such as arrival messages, appointments, and proximity alerts to a user in a manner of not interrupting the user. The location manager 350 may manage location information on the electronic device. The graphic manager 351 may manage a graphic effect to be provided to a user or a user interface relating thereto. The security manager 352 may provide various security functions necessary for system security or user authentication. When the electronic device includes a phone function, the middleware 330 may further include a telephony manager for managing a voice or video call function of the electronic device.

The middleware 330 may include a middleware module for forming a combination of various functions of the above-mentioned components. The middleware 330 may provide a module specialized for each type of OS to provide differentiated functions. Additionally, the middleware 330 may delete part of existing components or add new components dynamically.

The API 360, as a set of API programming functions, may be provided as another configuration according to OS. For example, in the case of Android® or iOS®, one API set may be provided for each platform and in the case Tizen®, at least two API sets may be provided for each platform.

The application 370 may include at least one application for providing functions such as a home 371, a dialer 372, an SMS/MMS 373, an instant message 374, a browser 375, a camera 376, an alarm 377, a contact 378, a voice dial 379, an e-mail 380, a calendar 381, a media player 382, an album 383, a clock 384, health care (for example, measure an exercise amount or blood sugar level of a person), or environmental information provision (for example, provide air pressure, humidity, or temperature information).

The application 370 may include an application (hereinafter "information exchange application") for supporting information exchange between the electronic device and the electronic devices 102 and 104. The information exchange application, for example, may include a notification relay application for relaying specific information to the external devices 102/104 or a device management application for managing the external electronic devices 102/104.

For example, the notification relay application may have a function for relaying to the electronic devices 102 and 104 notification information occurring from another application (for example, an SMS/MMS application, an e-mail application, a health care application, or an environmental information application) of the electronic device. Additionally, the notification relay application may receive notification information from the external electronic devices 102/104 and may then provide the received notification information to a user.

The device management application may manage (for example, install, delete, or update) at least one function (turn-on/turn off of the external electronic device itself (or some components) or the brightness (or resolution) adjustment of a display) of the electronic devices 102 and 104 communicating with the electronic device, an application operating in the external electronic device, or a service (for example, call service or message service) provided from the external device.

The application 370 may include a specified application (for example, a health care application of a mobile medical device) according to the property of the electronic devices 102 and 104. The application 370 may include an application received from the server 106 or the electronic devices 102 or 104. The application 370 may include a preloaded application or a third party application downloadable from a server. The names of components in the program module 310 according to the shown embodiment may vary depending on the type of OS.

At least part of the program module 310 may be implemented with software, firmware, hardware, or a combination thereof. At least part of the programming module 310 may be implemented (for example, executed) by a processor (for example, the processor 210). At least part of the programming module 310 may include a module, a program, a routine, sets of instructions, or a process to perform at least one function, for example.

Figure 4:
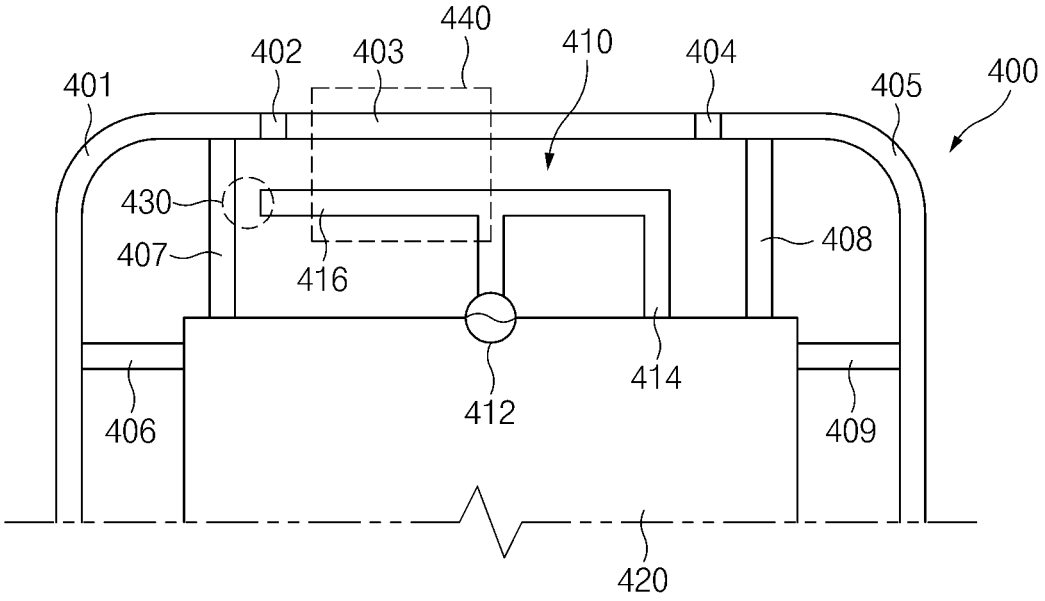
FIG. 4 is a diagram illustrating an electronic device and an antenna therein, according to an embodiment of the present disclosure.

Referring to FIG. 4, the electronic device 400 includes housings 401, 403, and 405, extension parts 406-409, an antenna 410, and a ground part 420, also referred to as a "ground element" to distinguish it from, e.g., ground part 414, described below, which is part of antenna pattern 410.

Referring to FIG. 4, the electronic device 400 includes housings 401 403, and 405, extension parts 406-409, an antenna 410, and a ground part 420.

The electronic device 400 may include the first housing 401 for a side thereof, the second housing 403 for an upper end thereof (, and the third housing 405 for a side of the electronic device 400 (that is, a side facing the first housing 401). Additionally, the electronic device 400 may further include a first segment part 402 disposed between the first housing 401 and the second housing 403 and a second segment part 404 disposed between the second housing 403 and the third housing 405.

The first housing 401, the second housing 403, and the third housing 405 may be metal housings. Additionally, the first segment part 402 and the second segment part 404, as a non-conductive material, may electrically insulate the first housing 401, the second housing 403, and the third housing 405 from each other. The first housing 401, the second housing 403, and the third housing 405 may be formed through an injection molding process.

The electronic device 400 includes the extension parts 406-409 extending from a ground part 420. The extension parts 406-409 may be connected to the first housing 401, the second housing 403, and the third housing 405 to support them in a fixed position. Referring to FIG. 4, although it is shown that the extension parts 406-409 are physically connected to the ground part 420, at least one of the extension parts 406-409 may also be electrically connected to the ground part 420, as will be described in greater detail with reference to FIG. 5.

The extension parts 406-409 may be integrally formed with the first housing 401, the second housing 403, and the third housing 405 and at least one of the extension parts 406-409 may be spaced apart from the first housing 401, the second housing 403, and the third housing 405.

The extension parts 406-409 may be a part of a bracket of the electronic device 400 and may be connected to the ground part 420 through a coupling part such as c-clip.

The antenna 410 includes a feeding part 412, a ground part 414, and an antenna pattern 416. Referring to FIG. 4, although it is shown that the antenna 410 is an inverted F antenna, for example, a planar inverted F antenna (PIFA), the type of the antenna 410 is not limited to the PIFA and may be one of various types of antennas such as a monopole antenna, a slot antenna, and a loop antenna.

The end of the antenna pattern 416 may be disposed at a position corresponding to the first segment part 402. The antenna pattern 416 may form a coupling with an adjacent conductive member. In relation to an antenna operating principle, in the case of a typical PIFA, since strong current is excited at the feed part 412 and strong voltage is excited at the end of the antenna pattern 416, which is an open area, the two areas may serve as a main radiation role for determining radiation. Accordingly, if the end of the antenna pattern 416 is disposed at a position corresponding to a metal housing (403 instead of the position corresponding to the first segment part 402, it may be coupled with the metal housing, and due to this, may deteriorate antenna performance. For example, when voltage is excited at a metal housing 403 having a larger volume in comparison to a very thin antenna signal line (for example, the antenna pattern 416), since main radiation occurs strongly at the second housing 403 where voltage is executed and the antenna 410 has characteristics of a coupling feeding part, even if the antenna 410 is changed for a design, radiation characteristics do not change.

The end of the antenna pattern 416 may form a coupling with the extension part 407 in an area 430. As mentioned above, since the extension part 407 is physically or electrically connected to the ground part 420, as a ground component, it may have a strong coupling with the end of the antenna pattern 416. The coupling at this point, for example, may be a point to point coupling. Coupling energy based on the coupling in the area 430 may be radiated through the segment part 402.

If there is no ground component because no extension part 407 is provided or the ground part 420 is not connected, the antenna pattern 416 parallel to the second metal housing 403 may form a coupling with the second metal housing 403 in an area 440. In this case, coupling with the conductive second metal housing 403 may deteriorate the performance of the antenna 410.

Accordingly, the end of the antenna 410, i.e., the end of the antenna pattern 416, is disposed at a position corresponding to the segment part 402, and the extension part 407 is coupled with the end of the antenna 410. Therefore, a main radiation area of the antenna 410 is fixed at the segment part 402 so that coupling with the conductive second metal housing 403 is reduced, which, in turn, results in an antenna having no interference due to a metal housing, and excellent radiation performance may be implemented.

The ground part may be formed on a printed circuit board (PCB).

Hereinafter, a low frequency band antenna, a high frequency band antenna, and a dual band antenna will be described with reference to FIGS. 5A, 6A, -7A, respectively. However, among contents described with reference to FIG. 4, overlapping contents corresponding to FIGS. 5A, 6A, and-7A will be omitted.

Figure 5A:
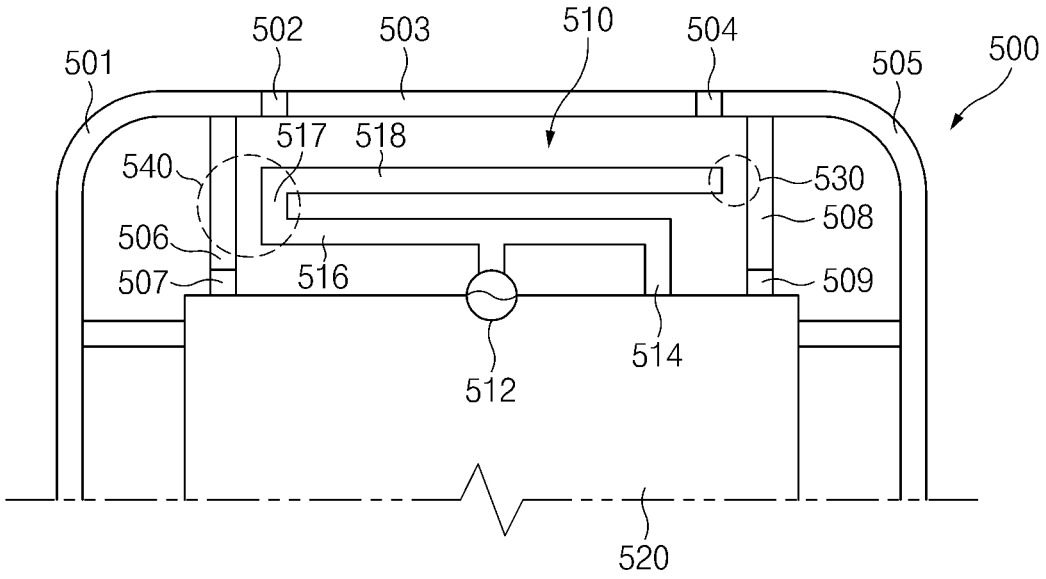
FIG. 5A is a diagram illustrating an electronic device and a low frequency band antenna therein, according to an embodiment of the present disclosure.

FIG. 5A is a diagram illustrating an electronic device 500 and a low frequency antenna 510 therein, according to an embodiment of the present disclosure. Referring to FIG. 5A, the electronic device 500 includes at least part of housings 501, 503, and 505, extension parts 506 and 508, an antenna 510, and a ground part 520, also referred to as a "ground element" to distinguish it from, e.g., ground part 514, described below, which is part of antenna pattern 510.

The extension parts 506 and 508 shown in FIG. 5A may be electrically connected to the ground part 520 unlike the extension parts 406-409 shown in FIG. 4. For example, the extension part 506 and the ground part 520 may be physically separated from each other but may be connected to each other through a capacitive element 507, for example, a lumped capacitor. Similarly, the extension part 508 and the ground part 520 may be connected to each other through the capacitive element 509.

The antenna 510 may include a feeding part 512, a ground part 514, a first antenna pattern 516, a second antenna pattern 517, and a third antenna pattern 518. The second antenna pattern 517 may be bent extending from the end of the first antenna pattern 516 and the third antenna pattern 518 may be bent extending from the end of the second antenna pattern 517. In this case, the second antenna pattern 517 may be disposed parallel to the extension part 506 and the third antenna pattern 518 may be disposed in parallel to the second housing 503.

Referring to FIG. 5A, the end of the third antenna pattern 518 may form a coupling (for example, point to point coupling) with the extension part 508 of a ground component in an area 530.

Additionally, the second antenna pattern 517 may form a coupling (for example, line to line coupling) with the extension part 506 of a ground component in an area 540. However, since it is not necessary that the second antenna pattern 517 and the extension part 506 are coupled to each other only when the second antenna pattern 517 and the extension part 506 are disposed in parallel to each other, the second antenna pattern 517 and the extension part 506 may have a mutual inclination angle. Additionally, the second antenna pattern 516 may form a coupling (for example, point to point coupling) with the extension part 506 of a ground component.

Therefore, the antenna 510 may cover a dual band through coupling in the area 530 and coupling in the area 540.

Figure 5B:
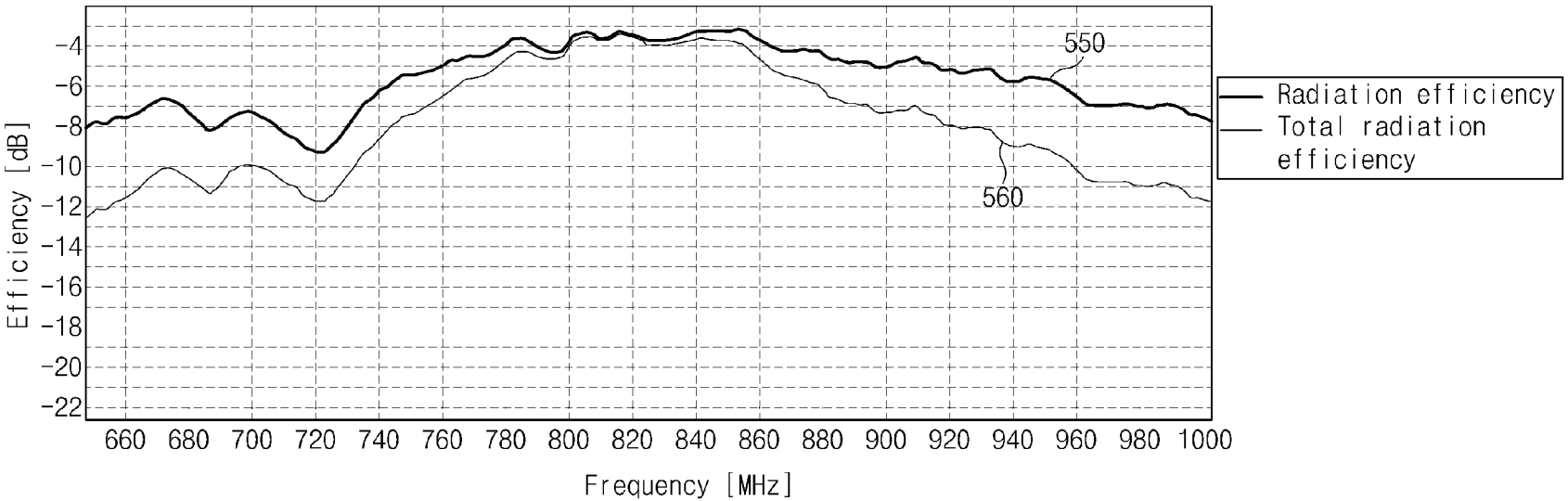
FIG. 5B is a graph illustrating a radiation efficiency for an antenna of FIG. 5A, according to an embodiment of the present disclosure.

FIG. 5B is a graph illustrating a radiation efficiency for an antenna of FIG. 5A, according to an embodiment of the present disclosure. Referring to FIG. 5B, a thick solid line 550 represents the radiation efficiency of the antenna 510 and a thin solid line 510 represents the total radiation efficiency of the antenna 510. In this case, the total radiation efficiency may be a value obtained in consideration of power lost or mismatch loss by a voltage standing wave ratio.

Figure 6A:
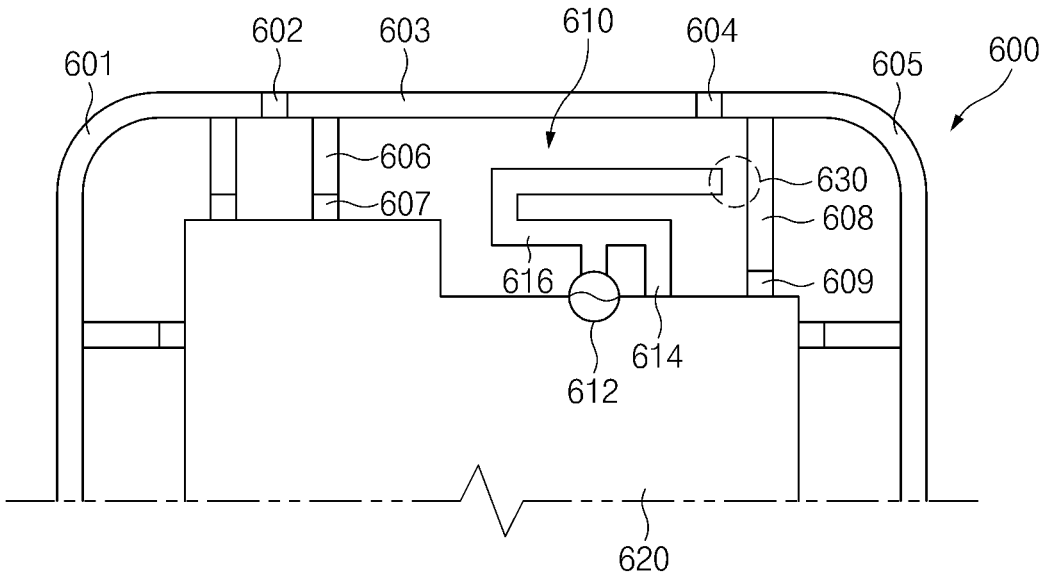
FIG. 6A is a diagram illustrating an electronic device and a high frequency band antenna therein, according to an embodiment of the present disclosure.

FIG. 6A is a diagram illustrating an electronic device 600 and a high frequency band antenna 610 therein, according to an embodiment of the present disclosure. Referring to FIG. 6A, the electronic device 600 includes at least part of housings 601, 603, and 605, extension parts 606 and 608, an antenna 610, and a ground part 620, also referred to as a "ground element" to distinguish it from, e.g., ground part 614, described below, which is part of antenna pattern 610.

Although it is shown that the second housing 403 of FIG. 4 and the second housing 503 of FIG. 5A are connected to another housing through a segment part, according to various embodiments of the present invention, the housing 603 may be connected to the ground part 620 through the extension part 606.

The antenna 610 includes a feeding part 612, a ground part 614, and an antenna pattern 616. The antenna pattern 616 may be coupled to the extension part 608 of a ground component in an area 630.

It is assumed that the antenna pattern 616 of the antenna 610 forms a double bending pattern like the antenna 510 of FIG. 5A but is spaced a predetermined distance apart from the extension part 606 and thus coupling occurs in the area 630.

In comparison of the antenna 510 of FIG. 5A and the antenna 610 of FIG. 6A, the lengths of antenna patterns are different from each other, i.e., the length of antenna 610 is shorter than a length of the antenna 510. Since the lengths of antenna patterns are inversely proportional to frequency bands, the antenna 510 of FIG. 5A may perform communication by using a relatively low band frequency and the antenna 610 of FIG. 6A may perform communication by using a relatively high band frequency.

Figure 6B:
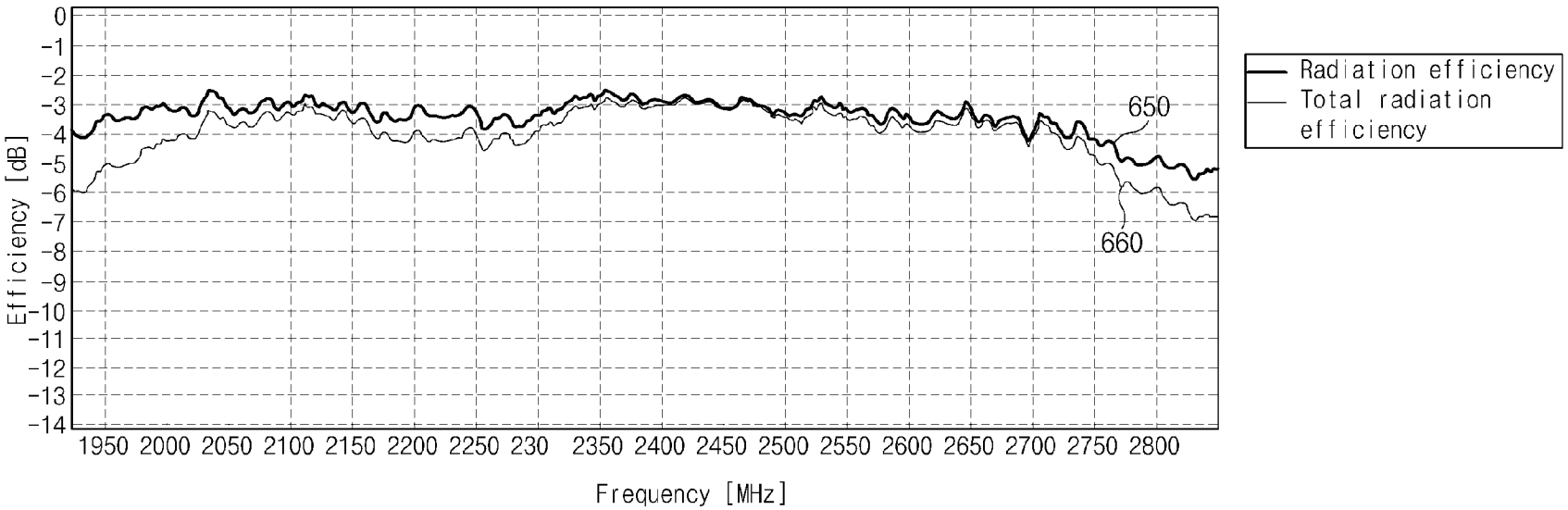
FIG. 6B is a graph illustrating a radiation efficiency for the antenna of FIG. 6A, according to an embodiment of the present disclosure.

FIG. 6B is a graph illustrating a radiation efficiency for an antenna of FIG. 6A, according to an embodiment of the present disclosure. Referring to FIG. 6B, a thick solid line 650 represents the radiation efficiency of the antenna 610 and a thin solid line 610 represents the total radiation efficiency of the antenna 610.

Figure 7A:
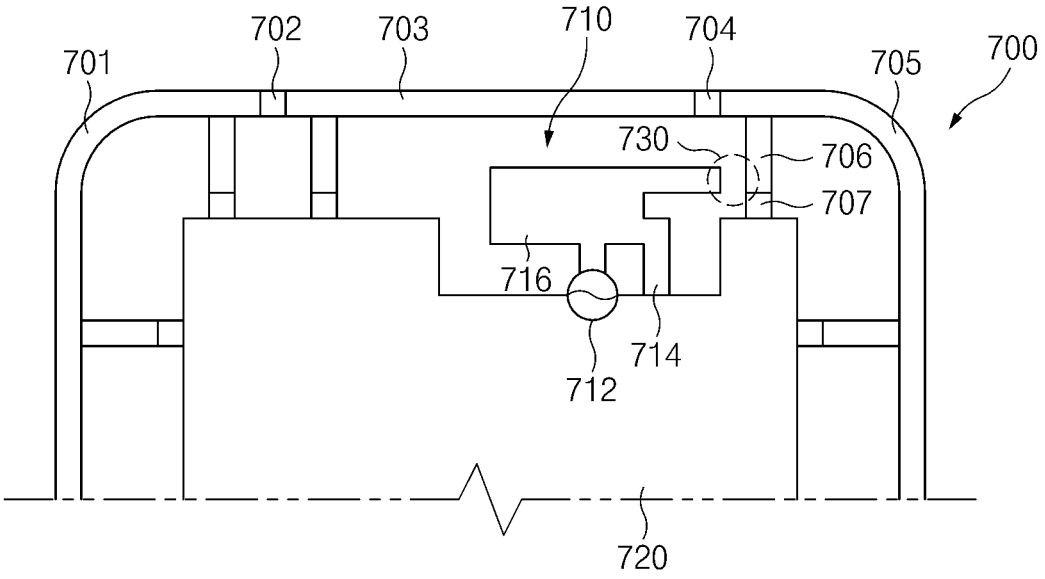
FIG. 7A is a diagram illustrating an electronic device and a double band antenna therein, according to an embodiment of the present disclosure.

FIG. 7A is a diagram illustrating an electronic device 700 and a double band antenna 710 therein, according to an embodiment of the present disclosure. Referring to FIG. 7A, the electronic device 700 includes at least part of housings 701, 703, and 705, an extension part 706, an antenna 710, and a ground part 720, also referred to as a "ground element" to distinguish to from, e.g., ground part 714 of antenna pattern 710.

Referring to the antenna 710, an antenna pattern 716 may form a coupling with the extension part 706 of a ground component in an area 730. Additionally, according to various embodiments of the present disclosure, an antenna pattern 716 may further form a coupling with the second housing 703 of a ground component.

In comparison of the antenna 710 of FIG. 5A and the antenna 610 of FIG. 6A, the thicknesses of antenna patterns forming each antenna may be different from each other.

Figure 7B:
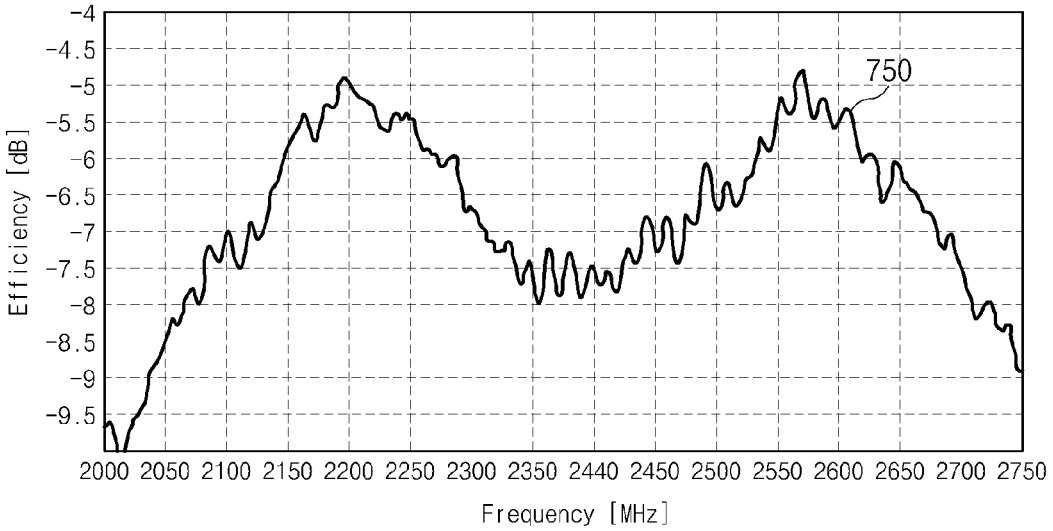
FIG. 7B is a graph illustrating a radiation efficiency for the antenna of FIG. 7A, according to an embodiment of the present disclosure.

FIG. 7B is a graph illustrating a radiation efficiency for an antenna of FIG. 7A, according to an embodiment of the present disclosure. Referring to FIG. 7B, a solid line 750 represents the radiation efficiency of an antenna 710.

At least two of the antenna 410, 510, 610, and 710 described with reference to FIGS. 4, 5A, 6A, and 7A may be provided to the electronic device.

Figure 8A:
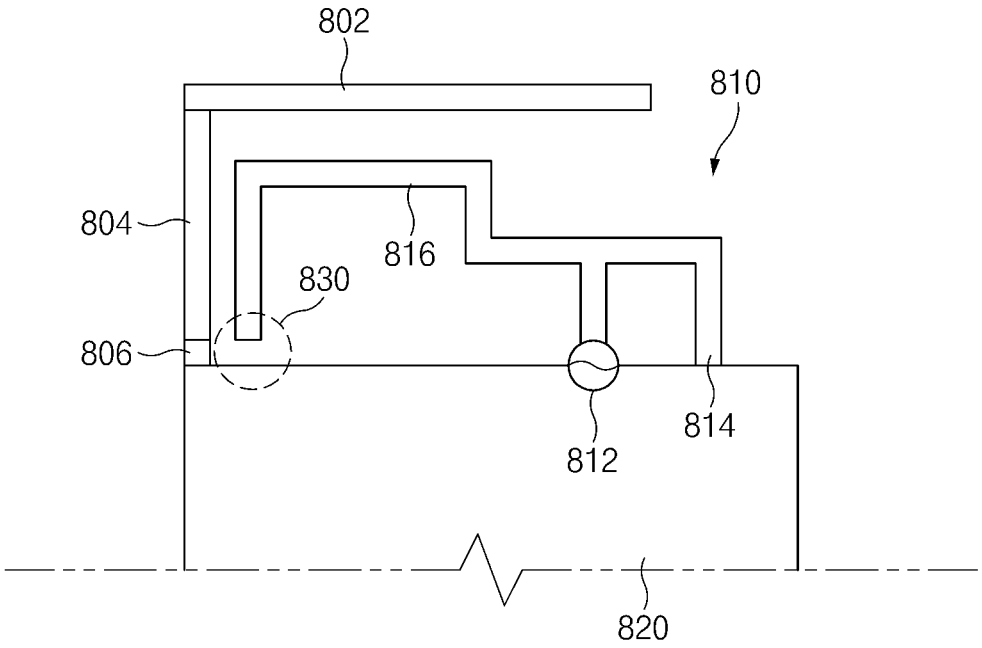
FIG. 8A is a diagram illustrating an electronic device and an antenna therein, according to an embodiment of the present disclosure.

FIG. 8A is a diagram illustrating an electronic device 800 and an antenna 810 therein, according to an embodiment of the present disclosure. Referring to FIG. 8A, the electronic device 800 includes at least part of a first housing 802, a second housing 804, a segment part 806, an antenna 810, and a ground part 820, also referred to as a "ground element" to distinguish it from, e.g., ground part 814 of antenna pattern 810. However, the first housing 802 or the second housing 804 may be a member for configuring a part of the electronic device 800 and performing a specific role.

It is assumed that the first housing 802 and the second housing 804 are metal housings. The segment part 806 may connect the second housing 804 and the ground part 820 and may be formed of a non-conductive material, e.g., plastic, rubber, ceramic, etc.

The antenna 810 includes a feeding part 812, a ground part 814, and an antenna pattern 816. The end of the antenna pattern 816 may be disposed toward the ground part 820 and may be disposed at a position corresponding to the non-conductive segment part 806. Accordingly, similar to the antenna 410 of FIG. 4, the end of the antenna pattern 816 may reduce a coupling by the conductive second housing 804 and may form a coupling with the ground part 820 in the area 830 at the same time. Accordingly, it is possible to prevent the deterioration of radiation efficiency by a conductive member.

Figure 8B:
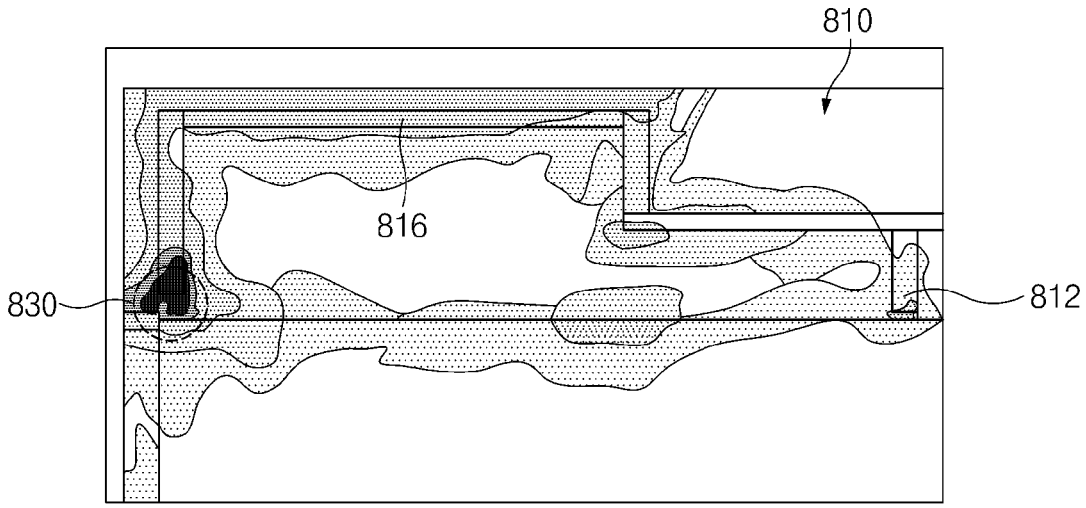
FIG. 8B is a view illustrating a radiation area of the antenna of FIG. 8A, according to an embodiment of the present disclosure.

FIG. 8B is a diagram illustrating a radiation area of the antenna 800 of FIG. 8A, according to an embodiment of the present disclosure. FIG. 8B corresponds to the antenna 810 of FIG. 8A and a density of the electrical field of FIG. 8B represents the intensity of an electric field produced by the antenna 810. For example, a very dense electrical field represents a strong electric field and a less dense electrical field represents a weak electric field.

Referring to FIG. 8B, a strong electric field may occur at the end of the antenna 816, that is, in the area 830 in comparison to another area. This is because coupling influence due to the conductive second housing 804 is reduced by the segment part 806 and coupling is formed between the end of the antenna pattern 816 and the ground part 820.

Figure 8C:
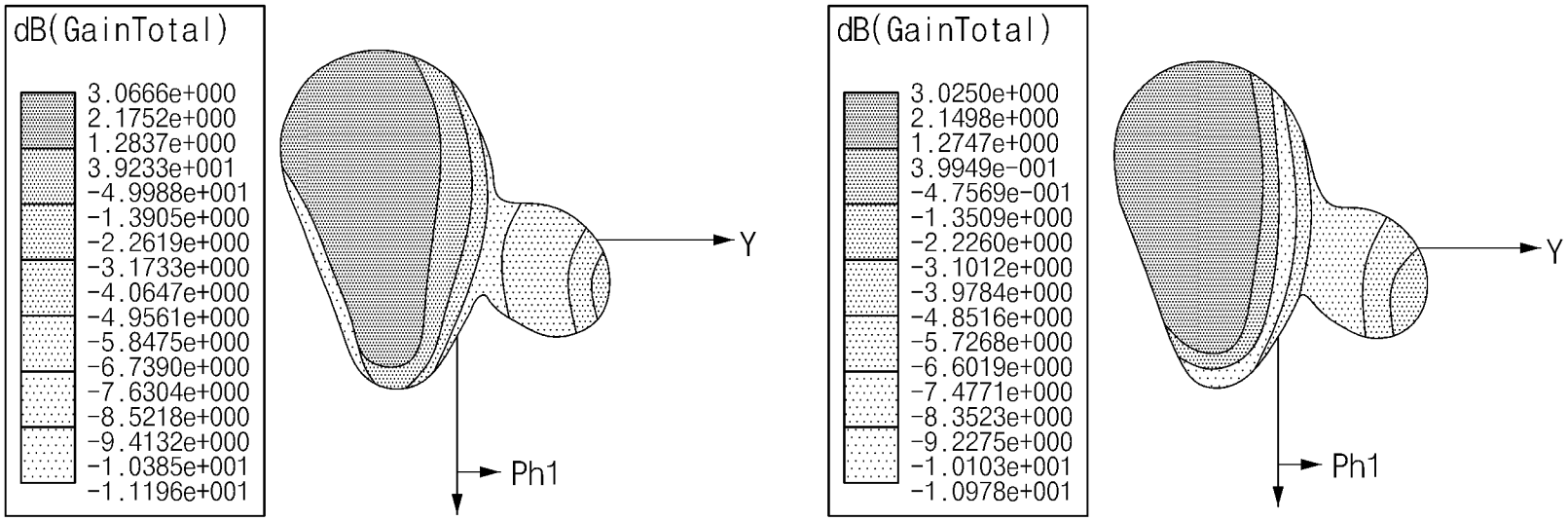
FIG. 8C is a diagram illustrating a three-dimensional radiation pattern of the antenna of FIG. 8A, depending on whether there is a housing, according to an embodiment of the present disclosure.

FIG. 8C is a diagram illustrating a three-dimensional radiation area of the antenna 810 of FIG. 8A, depending on whether there is a second housing, according to an embodiment of the present disclosure. A radiation pattern shown in the left of FIG. 8C is a case that only the antenna 810 is provided without the second housing 804 and a radiation pattern shown in the right of FIG. 8C is a case that the conductive second housing 804 and the antenna 810 are provided together.

The density shown in FIG. 8C represents a size (dB) of a gain. For example, a very dense area represents a strong gain and a less dense area represents a weak gain.

Referring to the densities of radiation patterns in the left and right sides of FIG. 8C, a gain with only the antenna 810 is 3.08 dB and a gain with the conductive second housing 804 and the antenna 810 together is 3.02 dB. From the foregoing, one skilled in the art can appreciate that the antenna 810 is insignificantly affected when using the conductive second housing 804.

In accordance with the present disclosure there is provided an electronic device that includes a housing including a segment part and an antenna, wherein an end of the antenna is disposed at a position corresponding to the segment part.

The electronic device may include a ground part, and an extension part extending from at least a part of the ground part, wherein the end of the antenna may be coupled with the extension part.

The antenna may be an inverted F antenna supporting a single band or a multi band.

The housing may be a metal housing.

The extension part may extend directly from at least a part of the ground part or may extend through a capacitive element.

The extension part may include a plurality of extension parts. Each of the plurality of extension parts may extend from different positions of the ground part, and the end of the antenna and at least a part of the antenna may be respectively coupled to the plurality of extension parts.

The antenna may be an inverted F antenna, and the antenna may include a F-shaped first antenna pattern of the inverted F antenna, a second antenna bent extending from an end of the first antenna pattern, and a third antenna pattern bent extending from an end of the second antenna pattern.

The third antenna pattern may be disposed parallel to a housing of the electronic device.

The coupling of the end of the antenna and the extension part may represent a point to point coupling of an end of the third antenna pattern and the extension part.

The second antenna pattern may be disposed parallel to another extension part and the second antenna pattern may be coupled with the another extension part.

The antenna may include a plurality of antennas and each of the plurality of antennas may support different bands.

In this case, each of the plurality of antennas may vary a length of an antenna pattern and each of the plurality of antennas may vary a thickness of an antenna pattern.

An antenna may include an antenna pattern, a feeding part configured to supply power to the antenna, and a ground part grounded to a ground area of an electronic device, wherein an end of the antenna pattern may be disposed at a position corresponding to a segment part included in a housing of the electronic device.

An antenna and an electronic device including the same may radiate energy by at least one coupling configuration generated from antenna patterns of the antenna.

The end of the antenna may be disposed to correspond to a segment part of a housing of the electronic device and may be coupled with an extension part of a ground component extending from a ground part of the electronic device, which may reduce an influence due to a coupling with a metal frame of the electronic device.

At least part of a device (for example, modules or functions thereof) or a method (for example, operations) according to this disclosure, for example, as in a form of a programming module, may be implemented using an instruction stored in a non-transitory computer-readable storage media. When at least one processor (for example, the processor 120) executes an instruction, it may perform a function corresponding to the instruction. The non-transitory computer-readable storage media may include the memory 130, for example.

The non-transitory computer-readable storage media may include hard disks, floppy disks, magnetic media (for example, magnetic tape), optical media (for example, CD-ROM, and DVD), magneto-optical media (for example, floptical disk), and hardware devices (for example, ROM, RAM, or flash memory). Additionally, a program instruction may include high-level language code executable by a computer using an interpreter in addition to machine code created by a complier. The hardware device may be configured to operate as at least one software module to perform an operation of various embodiments of the present disclosure and vice versa.

A module or a programming module may include at least one of the above-mentioned components, may not include some of the above-mentioned components, or may further include another component. Operations performed by a module, a programming module, or other components according to various embodiments of the present disclosure may be executed through a sequential, parallel, repetitive or heuristic method. Additionally, some operations may be executed in a different order or may be omitted. Or, other operations may be added.

While the present disclosure has been shown and described with reference to certain embodiments thereof, it should be understood by those skilled in the art that many variations and modifications of the method and apparatus described herein will still fall within the spirit and scope of the present disclosure as defined in the appended claims and their equivalents.

What is claimed is:

1. An electronic device comprising:

a housing including metal parts and an insulating segment part;

an antenna including an end portion including one end of the antenna and disposed at a position corresponding to the insulating segment part; and a ground element electrically connected to another end of the antenna and included in a printed circuit board (PCB), wherein the end portion of the antenna is disposed in close proximity with respect to both the ground element and the insulating segment part to reduce coupling influence due to the housing including metal parts and to radiate signals transmitted by the antenna through the insulating segment part.

2. The electronic device of claim 1, wherein the antenna is an inverted F antenna supporting at least one frequency band.

3. The electronic device of claim 1, wherein the ground element is electrically connected to the housing.

4. The electronic device of claim 1, wherein the antenna is an inverted F antenna comprising a first antenna pattern, which indicates an F-shape of the inverted F antenna, a second antenna pattern, which extends from an end of the first antenna pattern at a position where the second antenna pattern bends, and a third antenna pattern, which extends from an end of the second antenna pattern at a position where the third antenna pattern bends.

5. The electronic device of claim 4, wherein the third antenna pattern is disposed parallel to the housing of the electronic device.

6. The electronic device of claim 4, wherein the second antenna pattern is disposed parallel to an extension of the ground element and indirectly coupled to the extension.

7. The electronic device of claim 1, further comprising:

a plurality of antennas including the antenna, wherein each antenna of the plurality of antennas supports a different frequency band.

8. The electronic device of claim 7, wherein each antenna of the plurality of antennas has a length that is different than the other antennas.

9. The electronic device of claim 7, wherein each antenna of the plurality of antennas has a thickness that is different than the other antennas.

10. An electronic device comprising:

a housing including metal parts and an insulating segment part disposed between the metal parts;

an antenna including an end portion including one end of the antenna and disposed at a position corresponding to the insulating segment part; and a ground element electrically connected to another end of the antenna and included in a printed circuit board (PCB), an extension electrically connected to a ground element and extended from the ground element to near the insulating segment part, wherein the end portion of the antenna is disposed in close proximity with respect to both the extension and the insulating segment part to reduce coupling influence due to the housing including metal parts and to radiate signals transmitted by the antenna through the insulating segment part.

11. The electronic device of claim 10, wherein the extension is configured to support a portion of the housing.

* * * * *